United States Patent [19]

Unsworth et al.

[11] 3,960,609

[45] June 1, 1976

[54] PROCESS FOR HYDRIDING MAGNESIUM BASED ALLOYS

[75] Inventors: William Unsworth, Swinton, Manchester; Gordon Arthur Fowler, Whitefield, Manchester, both of England

[73] Assignee: Magnesium Elektron Limited, Manchester, England

[22] Filed: Sept. 13, 1974

[21] Appl. No.: 505,539

[30] Foreign Application Priority Data

Sept. 13, 1973 United Kingdom ..... 43032/73

[52] U.S. Cl. ..... 148/6.3; 148/11.5 M

[51] Int. Cl.[2] ..... C23C 11/00

[58] Field of Search ..... 148/6.3, 11.5 M

[56] References Cited

UNITED STATES PATENTS 2,703,298 3/1955 Branson et al. ..... 148/6.35

3,101,269 8/1963 Emley ..... 148/11.5 R

FOREIGN PATENTS OR APPLICATIONS 1,035,260 7/1966 United Kingdom

*Primary Examiner*—Ralph S. Kendall
*Assistant Examiner*—Charles R. Wolfe, Jr.
*Attorney, Agent, or Firm*—Karl W. Flocks

[57] ABSTRACT

Magnesium alloys are treated in a hydrogen atmosphere containing water vapor at an elevated temperature to enable hydrogen to diffuse into the alloy surface, the proportion of water vapor in the atmosphere being reduced during exposure. The alloy may be treated with chromic acid before exposure to increase the degree of penetration.

10 Claims, 1 Drawing Figure

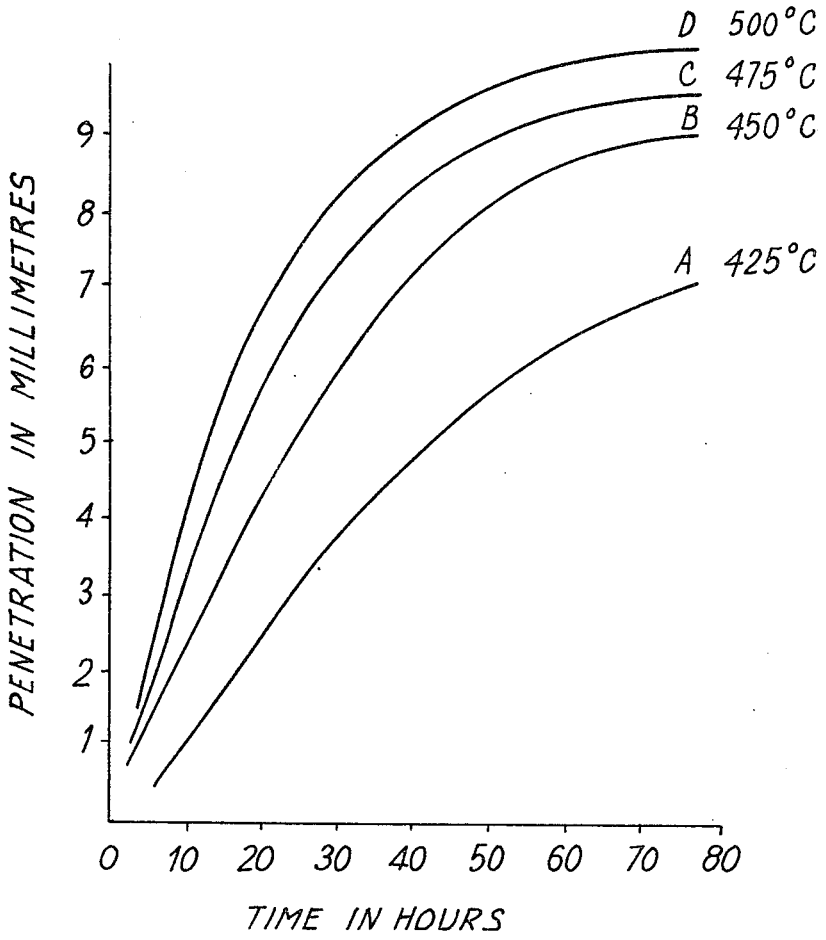
D 500°C
C 475°C
B 450°C
A 425°C
PENETRATION IN MILLIMETRES
1
2
3
4
5
6
7
8
9
0
10
20
30
40
50
60
70
80
TIME IN HOURS

PROCESS FOR HYDRIDING MAGNESIUM BASED ALLOYS

This invention relates to the treatment of magnesium-base alloys, generally containing at least 80% of magnesium, and especially to the introduction of hydrogen into such alloys.

The heat treatment of certain magnesium base alloys in hydrogen, such that the hydrogen diffuses into the solid alloy, provides beneficial results in regard to strength and other metallurgical characteristics, as disclosed in our British Patent Specification 1035260, which describes such an alloy system and teaches that the metallurgical change effected by hydrogen may be recognised by metallographic examination of the alloy. Such metallurgical change commences at the surface through which hydrogen is allowed to diffuse and continues progressively through the cross section of the article being heat treated. The rate at which the metallurgical change occurs may thus be expressed as a depth of penetration in a given time. British Patent Specification 1035260 further teaches that the rate of absorption of hydrogen in magnesium base alloys would be expected to increase if the hydrogen pressure was increased, in accordance with the known priciples of gas absorption.

In commercial exploitation of such alloys it is desirable to obtain a fast rate of penetration to minimise the time, and therefore the cost, of the hydrogen heat treatment. It is known that hydrogen may be introduced into solid magnesium alloys by heat treatment in a moist atmosphere, e.g. steam. Magnesium reduces the water vapour to liberate hydrogen and the magnesium is oxidised by the liberated oxygen. Such heat treatment of magnesium base alloys may be applied to articles of which the surface is subsequently removed by machining, e.g. billet and slab for plastic deformation, but it is not suitable for articles in substantially finished shape, e.g. castings for engineering structural use, because of the damage to the surface by oxidation.

Such articles may conveniently be heat treated in an atmosphere of hydrogen, specially designed furnaces are commercially available for such heat treatment. The working chambers of such furnaces are typically constructed of heat resistant metals, e.g. alloy steel and nickel base alloys, although mild steel may be used where only a limited life is required of a specific component of the furnace.

The hydrogen used in such heat treatment will generally contain some water vapour, this being derived in part from that usually present in the hydrogen supply and in part by reduction of oxides on the surface of the metallic components of the furnace structure. The moisture content of the hydrogen is normally expressed as the "dew point temperature."

SUMMARY OF THE INVENTION

According to one aspect of the invention, there is provided a process for treating magnesium alloys with hydrogen which comprises exposing the alloy at an elevated temperature to a hydrogen atmosphere containing water vapour, the proportion of water vapour in the atmosphere being reduced during said exposure.

DESCRIPTION OF PREFERRED EMBODIMENTS

The dew point of the atmosphere is preferably not lower than −20°C at the start of the treatment and is preferably lowered to about −40°C as the treatment progresses. The treatment required depends partly on the temperature used, which is advantageously of the order of 480°C: the higher the temperature, the shorter the time required for a given degree of penetration.

It has been found that a temperature below 400°C gives a very slow hydriding rate, and the upper limit on the hydriding temperature is the solidus of the alloy. However, if the temperature used is near the solidus the given size of the alloy may be seriously affected and accordingly it is usually desirable to limit the temperature to about 20° or 30° below that solidus.

The dew point of the atmosphere is most conveniently controlled by using a supply of gas comprising hydrogen having a relatively low dew point, for examply about −55°C, and adding water vapour to obtain the desired dew point for the gas within the enclosure used for the treatment, which may be a furnace of known type. The dew point may conveniently be measured by means of conventional instruments applied to the gas entering and leaving the furnace.

The required amount of water vapour is conveniently added to the gas by passing the gas over or through water or ice. The amount of water vapour supplied to the gas may be regulated by adjusting the temperature of the gas and/or water and the flow rate of the gas. This amount may also be regulated by using an aqueous solution, for example of an inorganic salt or of ethanol, the concentration of the solution being selected to give a suitable vapour pressure of water.

It is believed that exposure of the alloy to an atmosphere containing water vapour for a relatively short period "activates" the alloy surface so that efficient penetration by hydrogen is achieved, and that this surface "activation" persists even when the atmosphere is subsequently dry. For example, it has been found that when the hydrogen first fed to the furnace has a constant dew point, of the order of +15°C, the dew point of the gas leaving the furnace begins to fall after the first few minutes and reaches a very low value, for example −50°C, at the end of a 3-hour period of "wet" treatment. This drying indicates a reaction between the moisture and the magnesium surface and the rate of drying of the gas and may be used as a measure of the extent of surface activation, greater hydrogen penetration rates during subsequent "dry" treatment being achieved from more activated surfaces.

The process of the invention is advantageously carried out using substantially pure hydrogen as a source of the hydrogencontaining atmosphere. The process may be carried out using hydrogen diluted with an inactive gas such as nitrogen or argon but it is then found that the rate of hydriding is reduced, being approximately proportional to the partial pressure of hydrogen in the treating atmosphere. The process of the invention may be applied to any magnesium alloy containing at least one of zirconium thorium and the base earths including yttrium. It is particularly useful applied to such alloys which also contain zinc. A typical alloy of this type containing 4½% Zn and 1¼% rare earths and by weight which is preferably hydrided at 500° – 510°C. Another such alloy contains 5½% Zn and 1¾% thorium and Zr, and may be hydrided at 510°C.

It has been found that the solidus of magnesium alloys containing zinc is affected by the hydriding treatment. At zinc contents of less than 5½% by weight the solidus of the hydrided alloy is greater than that of the as-cast alloy; at zinc contents higher than 5½% the solidus of the hydrided alloy is lower than the as-cast alloy. The temperature of hydriding should therefore be lower for alloys having zinc contents in excess of 5½%

Embodiments of the invention will be described with reference to the following experimental Examples. The results are shown in the accompanying drawing.

A series of experimental heat treatments was carried out on an alloy described in British Patent Specification 1035260 and comprising nominally Zinc 5¾%, rare earth metals 2½%, zironium 0.6%. magnesium balance.

EXAMPLE 1

The furnace was constructed substantially of mild steel; the hydrogen supplied to the furnace had a dew point of −55°C; the magnesium articles were heated for 24 hours at 480°C. During the entire duration of this heat treatment it was found that the hydrogen leaving the furnace chamber had a dew point equivalent to, or slightly below ambient temperature, e.g. about +15°C. The magnesium articles had undergone the required hydrogen penetration but their surfaces were excessively oxidised and would have been unsuitable for commercial use.

EXAMPLE 2

The furnace was constructed substantially of heat resistant steel; the hydrogen had a dew point of −55°C. The surface oxides on the steel were progressively reduced by hydrogen, by gradually increasing the temperature such that the dew point of the hydrogen leaving the furnace did not exceed −40°C. The magnesium articles were then heat treated for 24 hours at 480°C while ensuring a maximum dew point of −40°C. No hydrogen penetration was found in these articles.

EXAMPLE 3

The furnace was constructed substantially of mild steel; the hydrogen supplied to the furnace had a dew point of −55°C; a series of cast rectangular blocks having dimensions 7cm × 7cm × 10cm were heat treated for various times and temperatures such that the dew point fo the hydrogen emerging from the furnace was about 0°C for about the first hour and fell to −40°C during the remainder of the heat treatment. The blocks were sectioned in the centre of the 10cm length and the depth of hydrogen penetration measured. The results are shown in the accompanying drawing, which shows plots of penetration depth against treatment time at different treatment temperatures. The surfaces of these blocks were satisfactorily free from oxidation.

EXAMPLE 4

Using a furnace constructed substantially of heat resistant steel and hydrogen having a dew point of −55°C, magnesium alloy articles were heat treated for 40 hours at 480°C such that the dew point of the hydrogen emerging from the furnace was controlled at −5°C for the first three hours of the treatment, then reducing to −40°C for the remainder of the heat treatment. Control of dew point during the first 3 hours was achieved by adding water to the hydrogen as required to achieve the desired dew point. The surfaces of the magnesium alloy articles were satisfactorily free from oxidation and the average depth of penetration was 9½mm.

These experiments demonstrate the unexpected effect that moisture in the hydrogen heat treatment atmosphere activates the surface of the magnesium alloy and makes it receptive to dryer hydrogen. Without such activation the surface is nonreceptive to hydrogen of low moisture content. The experiments further demonstrate that such surface activation may be developed without incurring excessive oxidation which would be detrimental to the magnesium article.

EXAMPLE 5

A furnace constructed substantially of stainless steel was used, and magnesium alloys were treated with a hydrogen atmosphere for 6 hours at 480°C. In successive trials (1) the hydrogen was dry throughout (dew point −70°C), (2) the hydrogen was "wet" for the first 3 hours (dew point +10°C) and dry for the remainder and (3) the hydrogen was "wet" for the whole six hours. The results are shown in Table 1.

TABLE I

| Duration of Wetting (hrs) | Inlet gas Dew Point (°C) | Penetration (mms) in 6 hrs at 480°C |
|---|---|---|
| None | −70°C | 0.6 |
| 6 | +10°C | 4.8 |
| 3 | +10°C during wetting<br>−70°C subsequently | 5.2 |

These results show that only an initial period of "wet" treatment is required to activate the alloy surface, and the surfact then remains active during subsequent "dry" treatment.

EXAMPLE 6

This example is intended to illustrate the effect of different initial "wetting" periods on the results obtained using the process of the invention. Magnesium alloy specimens were heat treated in a hydrogen atmosphere in a heat-resistant steel furnace at 480°C for a total of 40 hours. The process conditions and the depth of penetration obtained are shown in Table 2 below. The hydrogen dew point during "dry" treatment after "wetting" was −55°C.

TABLE 2

| | Flow rate of Hydrogen (f+3 per hour) | Wetting period (hrs) | Hydrogen Dew Pt. During Wetting(°C) | Average Penetration (mms) |
|---|---|---|---|---|
| 1 | 25 | NIL | −55 | 1 |
| 2 | 25 | 2 | −20 | 5½ |
| 3 | 25 | 4 | −10 | 7 |
| 4 | 55 | 3 | 0 | 7½ |
| 5 | 25 | 3 | +20 | 9½ |
| 6 | 12 | 40 | +20 | 12* |

Although excellent penetration had been acheived with specimen 6, the surface of this specimen showed excessive surface corrosion due to prolonged exposure to the "wet" atmosphere, rendering this specimen unacceptable for production castings. Surface oxidation of specimens 1–5 was considered satisfactory.

British Patent Specification 1035260 teaches that the surface treatment applied to Magnesium may influence the rate of hydrogen penetration. It has now been found that treatment of the alloy surface with chromic acid has the advantageous effect of increasing the extent of hydrogen penetration in the present invention.

The trials described in Example 7 below were carried out to illustrate the advantages obtained using this aspect of the invention.

EXAMPLE 7

Using cylindrical specimens 0.8 inches diam, and a heat treatment cycle in which the dew point of the hydrogen was about 0°C for the first hour of treatment, falling to −40°C thereafter, the results shown in Table 3 were obtained.

TABLE 3

| Surface Condition | Treatment | Penetration (mm) in 16 hrs. at 480°C (895°F) |
|---|---|---|
| 1. As Cast | Degreased | 8.5 |
| 2. Machined | Degreased | 10.0 |
| 3. Machined | Chromated | 8.0 |
| 4. Machined | Shot blasted; degreased | 8.8 |
| 5. Machined | Chromated; shot blasted | 8.7 |
| 6. Machined | Shot blasted; chromated | 7.8 |
| 7. Machined | Pickled in 5% $HNO_3$ | 5.2 |
| 8. Machined | Coated in oil | 4.0 |

In a further experiment, using similar conditions of heat treatment, specimens equivalent to Nos. 2 and 7 in Table 1 were immersed for 30 mins. in chromic acid, comprising 15% by weight chromium trioxide in water, at a temperature of 80°C before the hydrogen heat treatment.

The following unexpected results were obtained:

1. This treatment slightly increased the depth of penetration as compared to a machined and degreased specimen, and
2. This treatment largely mullified the deleterious effect of pickling in nitric acid.

Thus the treatment of magnesium alloy articles by immersion in chromic acid prior to hydrogen heat treatment may be used to amplify the beneficial results deriving from control of moisture of the hydrogen, as described above.

It has also been found that the treatment with chromic acid allows efficient hydriding to be obtained even in a hydrogen atmosphere which is "dry" throughout treatment. Chromic acid treatment followed by hydriding in "dry" hydrogen thus provides an alternative to the process of the invention.

We claim:

1. A process for hydriding magnesium alloys containing at least 80% by weight of magnesium, in two stages, comprising exposing the alloy at a temperature from 400°C to the solidus temperature of th alloy to a wet atmosphere of hydrogen having a dew point of at least −20°C for a period at least sufficient to effect activation of the alloy surface not exceeding 6 hours and then exposing the so treated alloy at a temperature from 400°C to the solidus temperature of the alloy to a dry atmosphere of hydrogen having a dew point not exceeding −40°C for a period sufficient to achieve the desired degree of hydriding.

2. A process in accordance with claim 1, wherein said temperatures are about 480°C to about 510°C.

3. A process in accordance with claim 1, wherein said temperatures are about 20°–30°C below the solidus temperature.

4. A process in accordance with claim 1, wherein the atmosphere of hydrogen during the first stage is substantially free of all reactive gas except water vapor and hydrogen, and said atmosphere of hydrogen in the second stage is essentially free of all reactive gas except hydrogen.

5. A process in accordance with claim 1, wherein said magnesium alloy is selected from the group consisting of a magnesium alloy containing about 4 ½% zinc and about 1 ¼% rare earths and a magnesium alloy containing about 5 ½% zinc and about 1 ¾% thorium and zirconium.

6. A process in accordance with claim 1, comprising, as a preliminary operation before the first stage exposure to the hydrogen atmosphere, contacting the magnesium alloy with chromic acid.

7. A process in accordance with claim 1, wherein the alloy comprises rare earth metals, a portion of which is incorporated in a grain boundary phase.

8. A process in accordance with claim 7, wherein the alloy contains from 0.25 to 10% by weight zinc.

9. A magnesium alloy treated in accordance with the process of claim 1.

10. A process in accordance with claim 1, wherein said wet atmosphere of hydrogen is obtained by passing a stream of hydrogen containing gas through a heated retort containing the alloy and water vapor is added to the gas fed to the retort by contacting the gas with water or ice.

* * * * *